US006672907B2

(12) United States Patent
Azuma

(10) Patent No.: US 6,672,907 B2
(45) Date of Patent: Jan. 6, 2004

(54) CONNECTOR

(75) Inventor: Eddie A. Azuma, Yokohama (JP)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/847,176

(22) Filed: May 2, 2001

(65) Prior Publication Data

US 2001/0055917 A1 Dec. 27, 2001

(30) Foreign Application Priority Data

May 2, 2000 (JP) ..... 2000-133971

(51) Int. Cl.[7] ..... H01R 33/00
(52) U.S. Cl. ..... 439/682; 439/857
(58) Field of Search ..... 439/682, 680, 439/74, 78, 857, 856

(56) References Cited

U.S. PATENT DOCUMENTS

| | | | | |
|---|---|---|---|---|
| 2,664,552 A | | 12/1953 | Ericsson et al. | 339/192 |
| 3,634,807 A | | 1/1972 | Muenchen et al. | 339/17 |
| 3,840,842 A | * | 10/1974 | Gabryelewicz | 339/158 |
| 3,867,008 A | | 2/1975 | Gartland, Jr. | 339/258 |
| 4,082,397 A | * | 4/1978 | Tanaka et al. | 339/49 |
| 4,140,361 A | | 2/1979 | Sochor | 339/258 |
| 4,717,361 A | | 1/1988 | Igarashi et al. | 439/856 |
| 4,740,180 A | | 4/1988 | Harwath et al. | 439/856 |
| 5,437,564 A | | 8/1995 | Lignelet | 439/701 |
| 5,545,051 A | | 8/1996 | Summers et al. | 439/350 |
| 5,876,219 A | | 3/1999 | Taylor et al. | 439/74 |
| 5,971,817 A | | 10/1999 | Longueville | 439/857 |
| 6,183,268 B1 | * | 2/2001 | Consoli et al. | 439/74 |

* cited by examiner

*Primary Examiner*—Alexander Gilman
(74) *Attorney, Agent, or Firm*—Woodcock Washburn LLP

(57) ABSTRACT

A suitable contact state is attained by an always stable contact pressure between a male contact and a female contact which form a tuning fork type contact. For a contacts providing a tuning fork type contact 2 that attains a contact state by inserting a male contact 4 between a pair of beams 6*a* and 6*b* provided on a female contact 6, in the connected state, male contact 4 and female contact 6 are arranged so as to maintain a state wherein the width direction of the male contact is angled relative to the direction of separation of the beams 6*a* and 6*b*.

6 Claims, 6 Drawing Sheets

CONNECTOR

FIELD OF THE INVENTION

The present invention relates to a connector that uses what is termed a tuning fork-type contact.

DESCRIPTION OF THE RELATED ART

One type of contact provided in connectors is what is termed a tuning fork-type contact. This tuning fork-type contact comprises a female contact with a pair of beams shaped like a tuning fork for connecting with a planar male contact. A state of contact is attained by the beams effecting a restoring force with respect to the male contact that has been inserted between the pair of beams of the female contact.

In the conventional tuning fork-type contact described above, because the contact pressure of the female contact is applied only by the elastic deformation of the pair of beams in the direction of separation, the contact pressure changes when there is even a minute change in the distance between the beams.

In view of the above circumstances, a need still exists for a connector that provides a tuning fork-type contact that can attain an appropriate contact state by a contact pressure that is always stable.

SUMMARY OF THE INVENTION

A contact having the following structure is preferably used as a means for satisfying the above-described need. Specifically, the invention is a connector providing a tuning fork-type contact that attains a contact state by inserting a planar shaped male contact between a pair of beams provided on the female contact, wherein the width direction of the male contact is disposed so as to be angled relative to the direction of separation of the pair of beams.

In this connector, because the width direction of the male contact is angled relative to the direction of separation of the beams of the female contact, when the male contact is inserted between the pair of beams of the female contact, the two beams deform so as to spread in the direction of separation, and in addition, deform so as to twist torsionally, centered on the direction of insertion. That is, in addition to the conventional two dimensional deformation in the direction of separation similar to the conventional technology, the two beams twist torsionally, centered on the direction of insertion, and as a result, deform three dimensionally. In addition, because contact pressure is attained by effecting the restoring force due to the torsionally twisting deformation of the beams as well, the contact pressure between the female and male contacts can be increased.

The connector is also characterized in that the angle of the width direction of said male contact with respect to the direction of separation of said pair of beams is equal to or greater than 30° and equal to or less than 60°. In this connector, an improvement in the contact pressure can be implemented by inserting the male contact with its width direction in a state angled relative to the direction of separation of the pair of beams. Upon more detailed examination, when the angle of the width direction of the male contact with respect to the direction of separation of the pair of beams is smaller than 30°, the amount of deformation in the direction of separation of the two beams becomes small, and a contribution to the contact pressure cannot be expected. In addition, when the angle of the width direction of the male contact with respect to the direction of separation of the pair of beams is larger than 60°, the amount of torsional twist of the two beams becomes small, and a contribution to the contact pressure cannot be expected. Therefore, the angle of the width direction of the male contact with respect to the direction of separation of the pair of beams is preferably equal to or greater than 30° and equal to or less than 60°. Furthermore, the angle is most preferably 45°, considering that the amount of torsional twist and the amount of deformation in the direction of separation of the two beams can both be suitably attained.

The connector is also characterized in that at least on one of the one housing that anchors said male contacts or on the other housing that anchors said female contacts, ribs are provided so as to partition the interior space in which said male contacts and female contacts are disposed. In this connector, the contact state between the female and male contact is attained by engaging one housing that anchors the male contacts and the other housing that anchors the female contacts, but if both housings are not correctly aligned when they are engaged, the edge of one housing is caught in the interior space of the other housing, and the female contacts will be damaged and deformed. In this situation, even if the housings are engaged with each other, a state of contact between the female and male contacts cannot be attained. The same can occur to the male contacts. Thus, when ribs are provided on at least one of the two housings, even if both housings are not correctly aligned, the edge of the one housing is guided by the rib, and does not get caught in the interior space of the other housing. Therefore, damage and deformation of the contacts can be prevented.

The contact can be characterized in that the external shape of the one housing that anchors said male contact is any equilateral polygon except a square, and said male contacts are disposed so that said width direction is parallel to the side of said one housing, and The external shape of the other housing that anchors said female contacts has an isomorphic shape that can engage with said one housing, and said female contacts are disposed so that said direction of separation is parallel to one edge of said other housing.

In this connector, the housings, having a polygonal external shape (excluding a square) are engaged together, and a contact state between the female and male contacts is attained, but if the male and female contacts are disposed as described above, the male contacts can realize a state angled relative to the female contact. For example, if the housing has the shape of an equilateral triangle, the angle of the width direction of a male contact with respect to a female contact can be 60°, 72° for an equilateral pentagon, 60° for an equilateral hexagon, or 45° for an equilateral octagon.

The connector can further be characterized in that ribs are provided on either said one housing or said other housing so as to partition the interior space in which said male contacts or female contacts are disposed. In a connector using housings whose external shapes are equilateral polygons, an effect identical to that described above can be attained by providing ribs.

The connector can be further characterized by a first connector, having a housing with a mating area defined by a perimeter in the shape of a polygon and a plurality of contacts in said mating area of said housing, wherein said plurality of contacts are angled relative to at least one side of said polygon. The connector can further include a second connector mateable with said first connector, wherein the second connector has a housing with a mating area substantially similar to said mating area of said first connector, and a plurality of contacts in said mating area of said housing. In such a connector, the plurality of contacts are generally parallel to or generally perpendicular to at least one side of said polygon corresponding to said at least one side of the perimeter of said polygon defining said mating area of said first connector. Still further, the connector can be characterized in that the first connector and the second connector are ball grid array-type contacts. The connector can also be characterized in that the plurality of contacts of the first connector are tuning fork-type contacts. Yet further, the connector can be characterized in that said polygons can be rectangular or equilateral. Still further, the polygons can have an even number of sides.

A novel connector system constructed in accordance with the present invention can also include first connector, having a housing and a plurality of generally planar contacts in said housing and a second connector mateable with the first connector. The second connector having a housing and a plurality of generally planar contacts in the housing, wherein during mating, the contacts of the first connector are angled relative to the contacts of the second connector.

A further novel system can include a first connector having a housing and at least one substantially planar contact blade mounted in the housing and a second connector having a housing configured to mate with the housing of said first connector and at least one substantially planar dual beam, tuning fork contact mounted in the housing, with a plane of the tuning fork type contact disposed angularly with respect to a plane of said contact blade. Upon insertion of the contact blade into the tuning fork contact along a mating axis, the beams of the tuning fork contact twist torsionally about axes generally parallel to the mating axis.

The connector of the present invention can also be characterized in that the contacts form a number of rows in the first connector and the contacts in the second connector form an equal number of rows. Still further, the connector can be characterized in that the plurality of contacts comprise at least one signal contact surrounded by six ground contacts.

BRIEF DESCRIPTION OF THE DRAWINGS

The foregoing and other aspects of the present invention will become apparent from the following detailed description of the invention when considered in conjunction with the accompanying drawings, in which.

PREFERRED EMBODIMENTS OF THE PRESENT INVENTION

Figure 1:
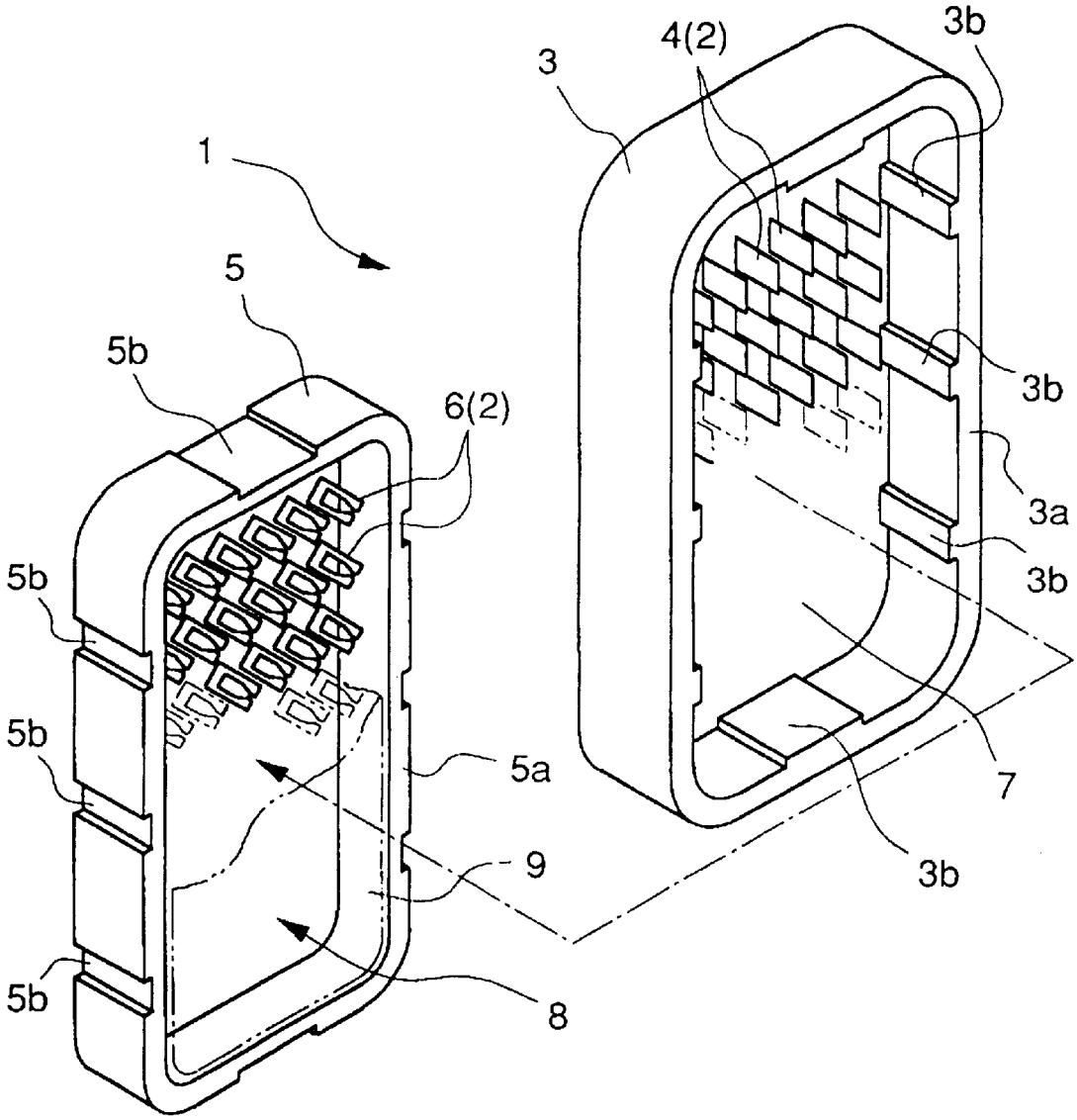
FIG. 1 is a perspective drawing showing the first embodiment of the contact according to the present invention.

A first embodiment of the connector according to the present invention will be explained referring to FIG. 1 through FIG. 4. The connector 1 shown in FIG. 1 has a first connector 1A that provides plurality of tuning fork-type contacts 2, and on which male contacts 4 are attached and arranged horizontally and vertically on one housing 3, and a second connector 1B on which the female contacts 6 are attached and arranged on the other housings so as to conform to the arrangement of the male contacts 4.

The housing 3 is rectangular when viewed in planar perspective, and on the perimeter edge, a mating area is defined by forming a wall 3*a* along the entire perimeter, and the part on which the male contacts 4 are attached forms a recess 7 (an interior space). The housing 5 is similarly rectangular, and on the perimeter edge, a mating area is defined by forming a wall 5*a* along the entire perimeter, and the part on which the female contacts 6 are attached forms a recess 8 (an interior space). Both housings 3 and 5 have a structure wherein the female and male contacts 4 and 6 attached to the respective recesses 7 and 8 are brought into contact by engaging the wall 5*a* so as to fit into the inside of the wall 3*a*. Moreover, the distal ends of the male contacts 4 and the female contacts 6 are both arranged so as to be lower than the edge of the walls 3*a* and 5*a*, and not exceed and protrude from the walls 3*a* and 5*a*.

The convexities 3*b* are formed in the height direction (that is, in the direction of the insertion of the male contact 4) on the inner surface of the wall 3*a*, and the grooves 5*b* are formed on the external surface of the wall 5*a* that engage along the convexities 3*b*. The engagement of the housings 3 and 5 is accurately carried out along the direction of insertion by the grooves 5*b* sliding into and engaging the convexities 3*b*. In addition, differences are provided in the sizes of the convexities 3*b* and the grooves 5*b* for each part of the rectangle, and the housings 3 and 5 can be engaged only when the convexities 3*a* and grooves 5*b* having the same size are brought together, and thus engagement in a mistaken orientation is prevented.

In the recess 8 of the housing 5, a guide member 9 is installed for protecting the female contact 6 and assisting the insertion of the male contact 4. The upper surface of the guide member 9 is formed so as to be flush with the upper edge of the wall 5*a*, and furthermore, guides holes (not illustrated) that pass through the male contact 4 are formed so as to correspond with each female contact 6.

Figure 2:
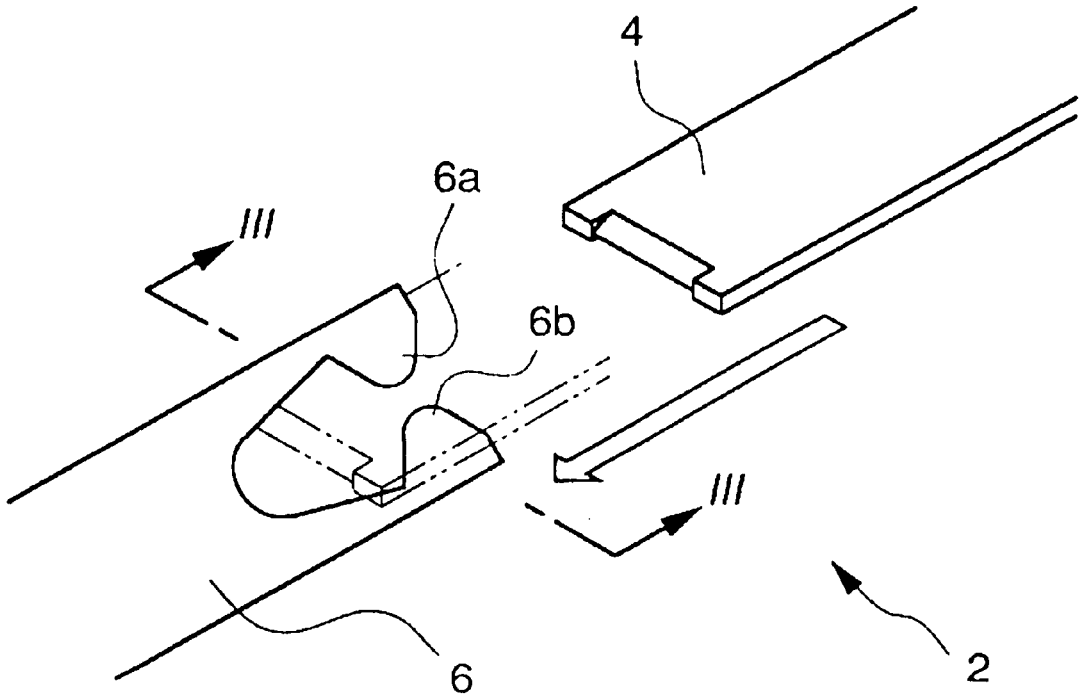
FIG. 2 is a perspective drawing showing the positional relationships between a male connector and a female connector when connected.

FIG. 2 shows the shape of a male contact 4 and a female contact 6, and the relative corresponding relationship there between when attached and connected in the housings 3 and 5. The male contact is machined by punching a metal plate, and a rectangular shape is imparted to the distal end. The female contact 6 is also machined by punching a metal plate, and a pair of beams 6*a* and 6*b* is formed on the distal end relative to the male contact 4. The distal end of the male contact 4, referred to as the blade part, is inserted between these beams 6*a* and 6*b*, and thereby a state of contact therebetween is attained.

All of the male contacts 4 are attached in parallel in the longitudinal direction of the housing 3. In addition, all of the female contacts 6 are attached at a 45° angle to the longitudinal direction of the housing 5. Thereby, when viewing the male contacts 4 and the female contacts 6 from the direction of insertion after the housings 3 and 5 are placed opposite each other so as to enable engagement, the width direction of the male contact 4 is angled at 45° relative to the width direction of the female contact 6, that is, in the direction of separation of the pair of beams 6*a* and 6*b*, by twisting torsionally around the axis orthogonal to the surface of the drawing (equivalent to the axis when both contacts are engaged).

Figure 3:
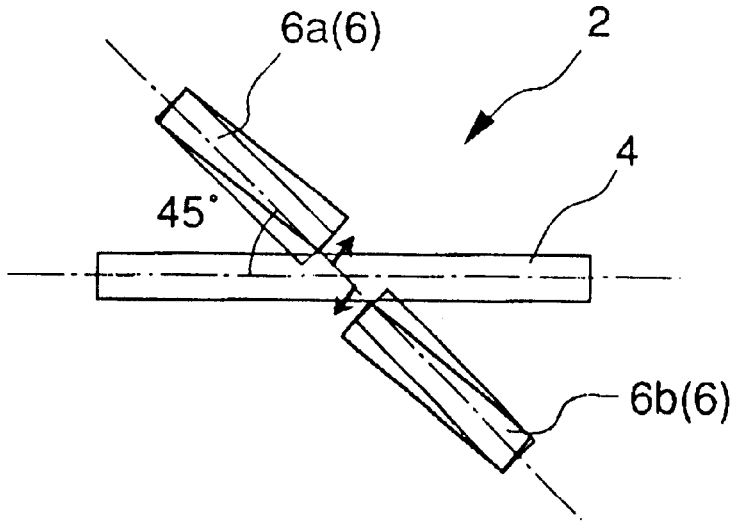
FIG. 3 is a cross-sectional view along the line III—III in FIG. 2.

In the connector 1 structured in the above-described manner, when the housings 3 and 5 are place opposite each other so as to enable engagement and gradually brought into contact, the distal ends of the male contacts 4 are inserted between the pairs of beams 6*a* and 6*b* of the female contacts 6 by pushing open these beams 6*a* and 6*b*. At this time, because the male contacts 4 are angled relative to the female contacts 6, in addition to the two beams 6*a* and 6*b* being deformed so as to widen in the direction of separation, as shown in FIG. 3, the beams 6*a* and 6*b* are deformed so as to twist torsionally, centered on the direction of insertion of the male contacts 6. That is, in addition to deforming two dimensionally in the direction of separation as occurs conventionally, the two beams 6*a* and 6*b* twist torsionally, centered on the direction of insertion, and as a result, deform three dimensionally. Thereby, the contact pressure between the female and male contact is increased.

Figure 4:
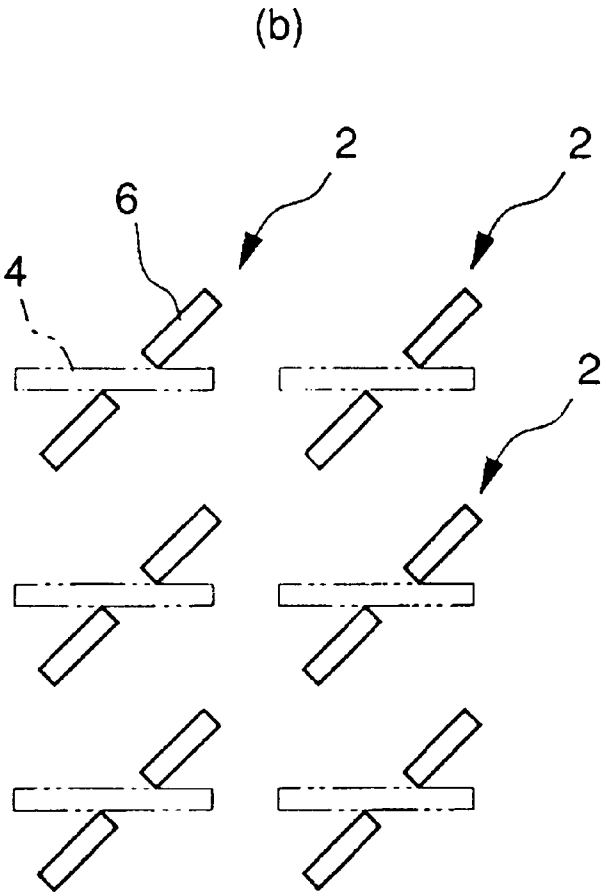
FIG. 4 is a planar drawing showing the difference in space necessary for arranging the tuning fork type contacts in (a) a connector using the tuning fork type contacts in a conventional arrangement, and (b) a connector using the tuning fork contact of the present invention.
Figure 4:
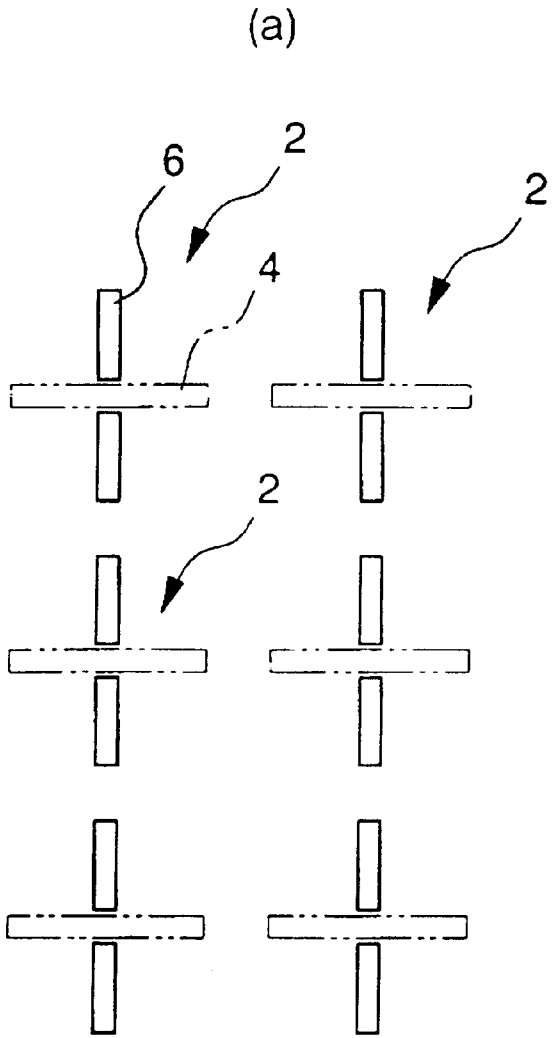

In addition, in the above-described contact 1, the effects as explained in the following can be expected. As shown in FIG. 4, when comparing the connector using the tuning fork type contacts as conventionally arranged and the connector 1 using the tuning fork type contacts 2 of the present invention, because the female contacts 6 are arranged at an angle, the necessary space for one tuning fork type connector 2 is reduced. Thus, for example, in the case that a connector having the same number of contact points is constructed, the external dimensions of the connector of the present invention can be made smaller than those of the conventional connector.

Incidentally, in the present embodiment, the females contacts 6 are attached angled 45° with respect to the housing 5. While this angle is optimized at 45°, if the angle is within the range equal to or greater than 30° or equal to or less than 60°, the beams 6*a* and 6*b* are deformed three dimensionally, and an advantageous contact pressure can be attained.

In addition, in the present invention, the female contacts 6 are attached angled relative to the housing 5, but the male contacts can be attached angled relative to the housing 3. In addition, the female contacts 6 can be attached in the longitudinal direction of the housing 5.

Figure 5:
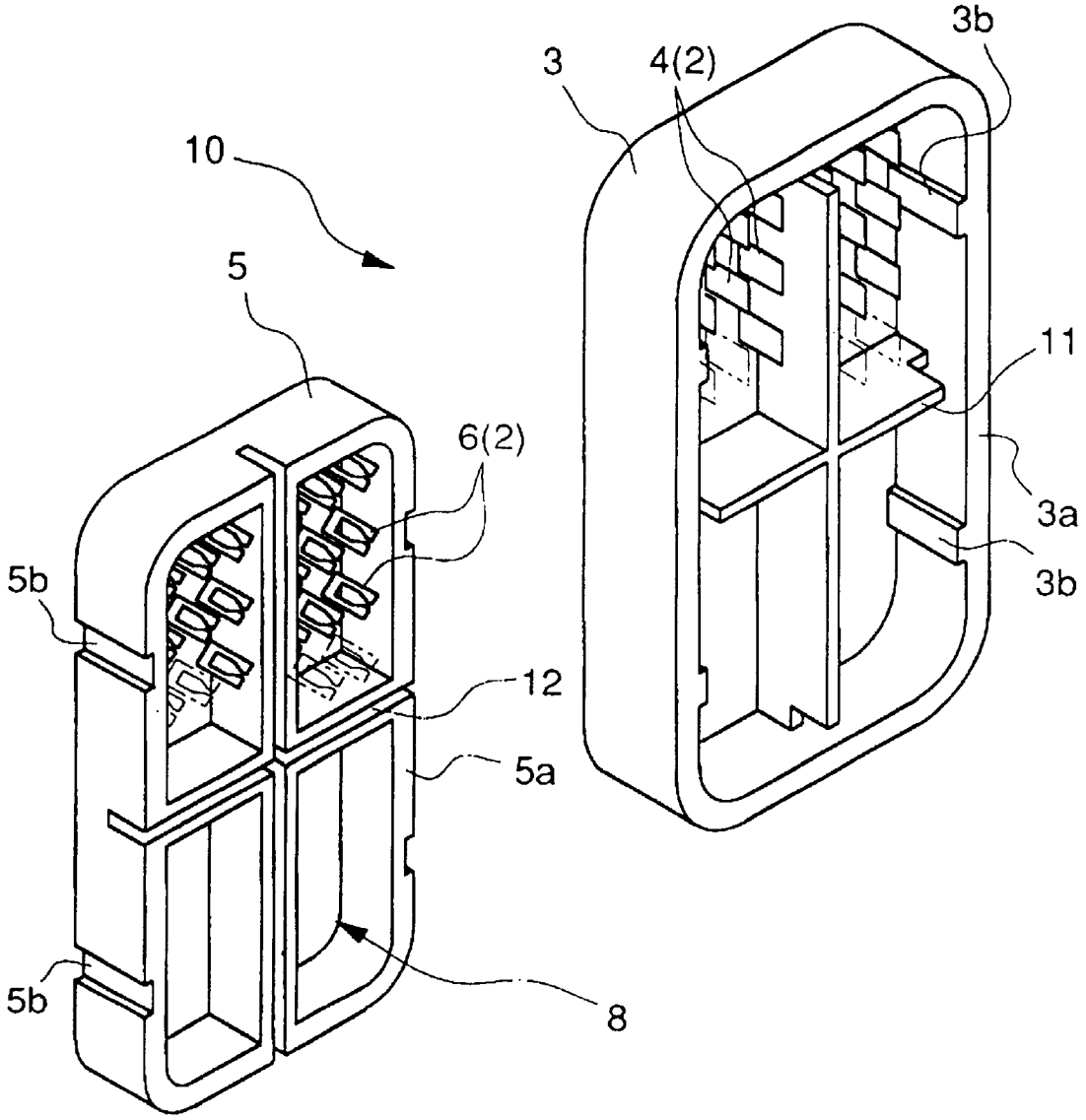
FIG. 5 is a perspective drawing showing a second embodiment of the connector according to the present invention.

Next, a second embodiment of the present invention will be explained referring to FIG. 5. Constituent elements that have already been explained in the first embodiment have identical reference numerals, and their explanation has been omitted.

In the connector 10 of the present embodiment, a guide member 9 is added, and the following type of structure is used. Specifically, on the housing 3, the stepped projecting ribs 11 are formed horizontally and vertically so as to divide the recess 7 into four parts, and on the other housing 5, receiving ribs 12 forming a groove 12*a* that receives the ribs 11 are formed horizontally and vertically so as to divide the recess into four parts. The height of ribs 11 is made equal to that of the walls 3*a*, and the height of the receiving ribs 12 is firmed so as to be equal to that of the wall 5*a*.

In the connector 10 in the present embodiment, by respectively providing ribs 11 in the housing 3 and receiving ribs 12 in housing 5, even in the case that the housings 3 and 5 are not correctly aligned, the edge of the one housings does not becomes caught to the recess of the other housing due to being guided by the ribs 11 (or the receiving ribs 12). For example, in the case that the housing 5 is misaligned in the direction of the plane with respect to the housing 3, the wall 3*a* of the housing 3 and the rib 12 receive the edge of the housing (the wall 5*a*), and the housing 5 is guided at three or four points by the wall 3*a* and the ribs 12, and the male contacts 4 are not damaged or deformed. The opposite case is identical.

Figure 6:
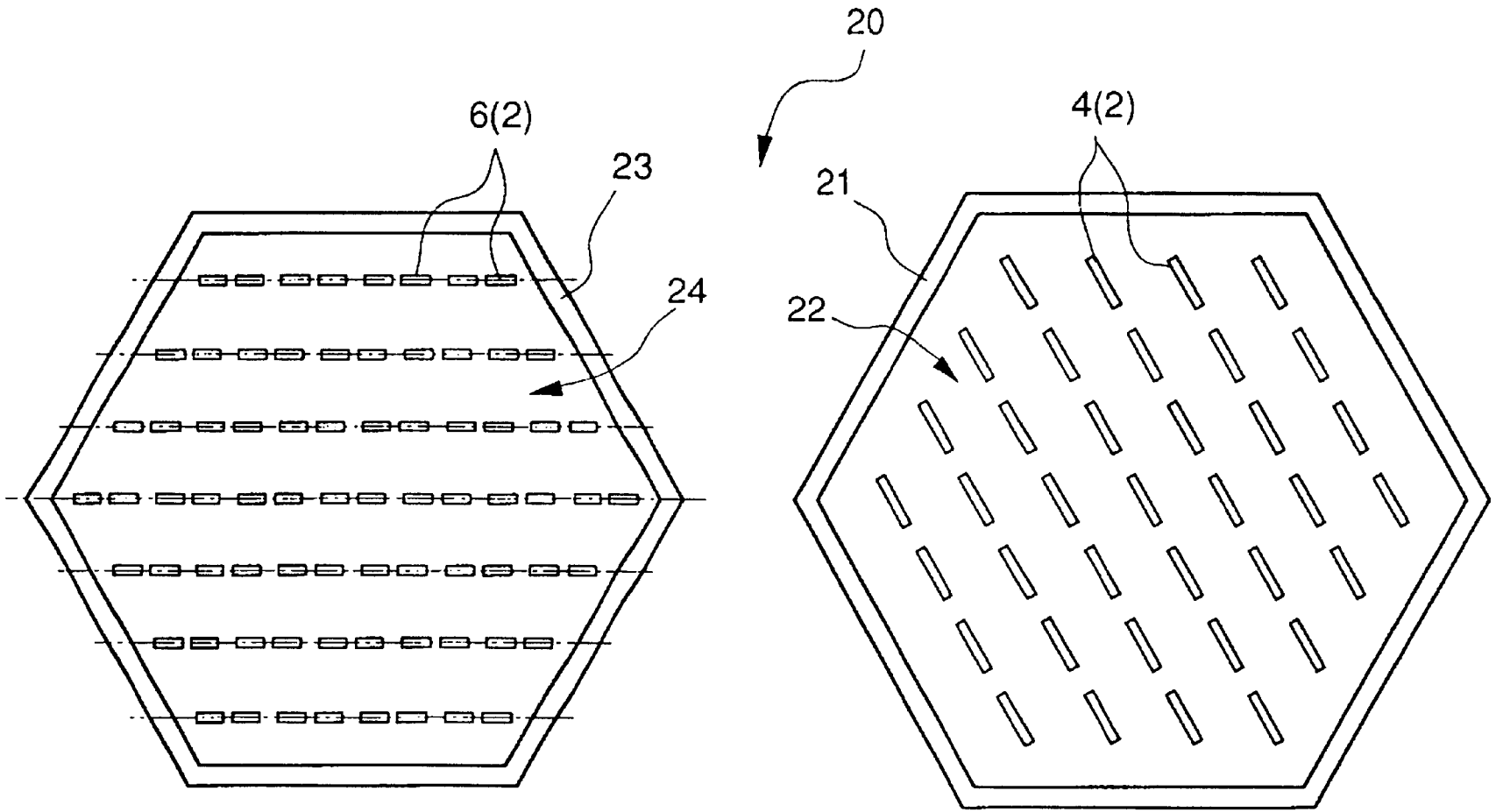
FIG. 6 is a planar drawing showing a third embodiment of the connector of the present invention.
Figure 7:
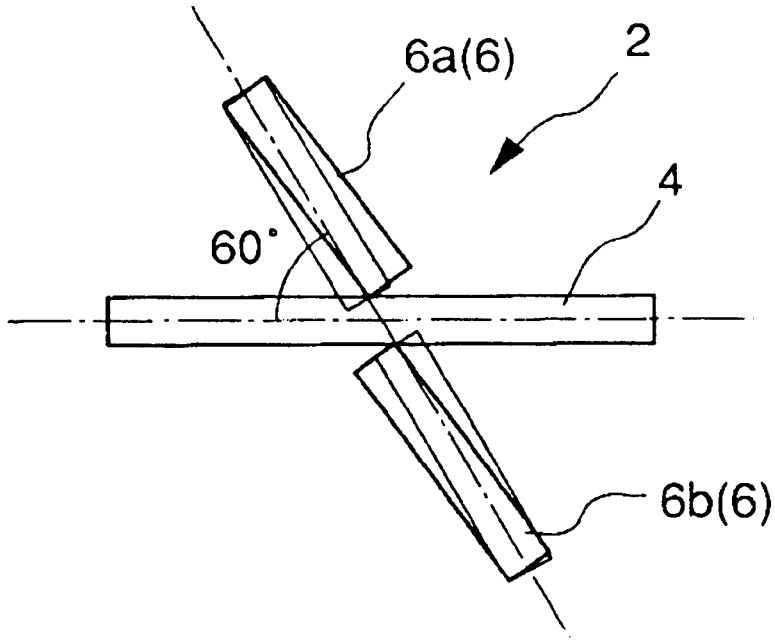
FIG. 7 is a planar cross-sectional drawing showing the positional relationships between a male contact and a female contact when connected.

Next, the third embodiment of the connector of the present invention will be explained referring to FIG. 6 and FIG. 7. Constituent elements that have already been explained in the first embodiment have identical reference numerals, and their explanation has been omitted. In the connector 20 of the present embodiment, as shown in FIG. 6, the external shape of the housing 21 is a hexagon, and a plurality of male contacts 4 attached to the recess 22 is disposed so that their width direction is parallel to one side of the housing 21. The external shape of the other housing 32 has an identical shape for engaging with the housing 21, and a plurality of female contacts 6 attached to the recess 24 are arranged so that the direction of separation of the beams 6*a* and 6*b* is parallel to one side of the housing 23.

In the connector 20 constructed in the above-described manner, engaging the housings 21 and 23, whose external shape is hexagonal, together, attains contact state of the male and female contacts 4 and 6. As shown in FIG. 7, by disposing the female and male contacts 4 and 6 in the above-described manner, a state in which the male contact is angled 60° relative to the female contact 6 can be realized. In addition, by using the present embodiment in the same manner as the above-described first embodiment, the contact pressure between the female and male contacts 4 and 6 can be increased.

In addition, in the above-described connector 20, the secondary effects as described below can be expected. During manufacture of the connector 20, for example, during the operation of attaching the male contacts 4 to the housing 21, the plurality of male contacts 4, as shown in FIG. 6, are divided into groups along each of the broken lines shown in FIG. 6, and can be attached as groups to the housing 21. It is clear that the number of the attachment operations of the connector 20 is fewer when compared to the case that connector 1, which has, for example, a rectangular shape, is assumed to have an identical number of points. This means that cost reductions during manufacture can be implemented when a shape such as that of connector 20 is used.

Moreover, in the present embodiment, the housings 21 and 23 have a hexagonal shape, but the shape of the housing can use any polygon except a square, on the assumption that the male contacts 4 will be arranged parallel to one side of the housing and that the female contacts 6 will be arranged parallel to one side of the housing. In addition, if the housing is given an equilateral triangle shape, the male contact 4 can be angled at 60° with respect to the female contact 6, at 72° for an equilateral pentagon, and at 45° for an equilateral octagon. However, the shape of these housings is preferably appropriately selected depending on such conditions as the number of terminals and the manufacturing processing.

In the present embodiment, a connector using a tuning fork type contact was explained, but the present invention is a technology that can be employed with ball grid array-type connectors.

As explained above, according to the connector of the present invention, because the male contacts are angled relative to the female contacts, when the male contacts are inserted between the pair of beams of the female contacts, in addition to the two beams deforming so as to spread in the direction of separation, they deform so as to twist torsionally, centered on the insertion direction, and because the restoring force is effected by this torsionally twisting deformation as well, the connection pressure between the female and male contacts can be increased.

According to the connector of the present invention, by the male contacts being angled equal to or greater than 30° or equal to or less than 60° with respect to the female contacts, the amount of torsional twisting and the direction of separation of the two beams can be both suitable attained, and the contact pressure between the female and male contacts can be increased.

According to the connector of the present invention, by providing ribs on at least one of the two housings, even when the two housings are not correctly aligned, the edge of one housing is guided by the ribs and does not become caught in the inside space of the other housing. Thereby, damage and deformation of the contacts can be prevented.

According to the connector of the present invention, a contact state between the female and male contacts can be attained by engaging the housings, whose external shape is a polygon (excluding a square), together, and if the female and male contacts are arranged so as to be parallel to one side of their respective housings, a state can be realized in which the male contacts are angled relative to the female contacts.

According to the connector of the present invention, even in a connector using a housing whose external shape is an equilateral polygon, the same effects as those described above can be attained by providing ribs.

Although illustrated and described herein with reference to certain specific embodiments, the present invention is nevertheless not intended to be limited to the details shown. Rather, various modifications may be made in the details within the scope and range of equivalents of the claims and without departing from the invention.

What is claimed is:

1. A connector, comprising: (i) a first connector comprising a first housing having an external shape of an equilateral polygon having at least three substantially non-parallel sides, and a plurality of substantially planar contact blades mounted in the first housing and being substantially parallel to a plurality of of said sides; and (ii) a second connector comprising a second housing configured to mate with said first housing and a plurality of substantially planar dual beam tuning fork contacts mounted in the second housing, wherein planes of said tuning fork contacts are substantially parallel to a plurality of side of said second housing and are disposed angularly with respect to planes of said contact blades when said first and second housings are mated, whereby, upon insertion of said contact blades into said tuning fork contacts along mating axes, the beams of said tuning fork contacts twist torsionally about axes generally parallel to said mating axes, wherein said substantially planar contact blades and said tuning fork contacts are evenly distributed with respect to all of said sides of said respective first and second housings.

2. The connector according to claim 1, wherein the angle of the width direction of said substantially planar contact blades with respect to the direction of separation between said pairs of beams is equal to or greater than approximately 30° and equal to or less than approximately 60°.

3. The connector according to claim 2, wherein the angle of the width direction of said substantially planar contact blades with respect to the direction of separation between said pairs of beams is predetermined according to the number of sides of said equilateral polygon.

4. The connector according to claim 1, wherein the angle of the width direction of said substantially planar contact blades with respect to the direction of separation between said pairs of beams is predetermined according to the number of sides of said equilateral polygon.

5. The connector according to claim 1, wherein said first connector and said second connector are ball grid array-type connectors.

6. The connector of claim 1, wherein the external shape of the first housing is one of a triangle, a pentagon, and a hexagon.

* * * * *